United States Patent [19]

Rhodes et al.

[11] Patent Number: 5,035,820

[45] Date of Patent: Jul. 30, 1991

[54] OIL COMPOSITIONS CONTAINING MODIFIED STAR POLYMERS

[75] Inventors: Robert B. Rhodes, Houston, Tex.; Rudolf J. A. Eckert, Huffelsheim, Fed. Rep. of Germany

[73] Assignee: Shell Oil Company, Houston, Tex.

[21] Appl. No.: 523,517

[22] Filed: May 15, 1990

[51] Int. Cl.[5] ..... C10M 149/00

[52] U.S. Cl. ..... 252/50

[58] Field of Search ..... 252/50

[56] References Cited

U.S. PATENT DOCUMENTS

| | | | |
|---|---|---|---|
| 4,222,882 | 9/1980 | Brulet et al. | 252/51.5 |
| 4,229,308 | 10/1980 | Brulet et al. | 252/47 |
| 4,358,565 | 11/1982 | Eckert | 525/280 |
| 4,409,120 | 10/1983 | Martin | 252/50 |
| 4,427,834 | 1/1984 | Martin | 525/280 |
| 4,557,849 | 12/1985 | Eckert | 252/50 |
| 4,693,838 | 9/1987 | Varma et al. | 252/51.5 |
| 4,699,723 | 10/1987 | Kapuscinski et al. | 252/47 |
| 4,780,228 | 10/1988 | Gardiner et al. | 252/51 |
| 4,820,776 | 4/1989 | Kapuscinski et al. | 525/279 |

FOREIGN PATENT DOCUMENTS

| | | |
|---|---|---|
| 029622 | 6/1981 | European Pat. Off. . |
| 171167 | 2/1986 | European Pat. Off. . |
| 1601079 | 10/1981 | United Kingdom . |

*Primary Examiner*—Prince E. Willis
*Assistant Examiner*—E. McAvoy
*Attorney, Agent, or Firm*—James O. Okorafor

[57] ABSTRACT

Lubricating oil compositions which contain hydrogenated diene star polymers grafted with N-vinylimidazole exhibit improved engine performance when prepared by grafting the polymer in an oil mixture containing at least 6% by weight of the star polymer. The grafting is accomplished by contacting the polymer with from about 3.0 to about 5.5 wt % N-vinylimidazole when N-vinylimidazole is the sole reactant and from about 1.0 to about 5.0 wt % N-vinylimidazole when N-vinylimidazole is used in combination with N-vinylpyrrolidone.

13 Claims, No Drawings

OIL COMPOSITIONS CONTAINING MODIFIED STAR POLYMERS

BACKGROUND

This invention relates to dispersant viscosity index improver concentrates for lubricating oil compositions and to lubricating oil compositions containing the same and to a method of making same. More particularly this invention relates to lubricating oil compositions containing nitrogen modified star polymers of hydrogenated conjugated dienes and to concentrates containing the same and to a method for preparing such modified star polymer concentrates.

U.S. Pat. No. 4,358,565 and EP 029,622 describe lubricating oil compositions containing a grafted star polymer. The star polymers are grafted with a nitrogen-containing polymerizable polar organic compound to improve dispersancy. The preferred nitrogen-containing compounds are 2-vinylpyridine and 4-vinylpyridine. Many other nitrogen-containing compounds are listed in the specification, including N-vinylimidazole and N-vinylpyrrolidone. The specification does not limit the nitrogen content of the compositions.

U.S. Pat. No. 4,820,776 describes lubricating oil compositions containing a grafted diene polymer. The diene polymers are grafted with both a nitrogen-containing polymerizable polar organic compound and a second component. The preferred nitrogen-containing compound is N-vinylpyrrolidone which was used in many of the examples. The specification mentions that 1-vinylimidazole or 4-vinylpyridines can be grafted although the products are not described.

U.S. Pat. No. 4,222,882 describes lubricating oil compositions containing a grafted star polymer. The star polymers are grafted with N-vinylpyrrolidone to improve dispersancy.

U.S. Pat. No. 4,229,308 describes lubricating oil compositions containing a grafted star polymer. The star polymers are grafted with a compound containing two C-N=C segments.

U.S. Pat. Nos. 4,693,838 and 4,780,228 and EP 171,167 describe lubricating oil compositions containing a grafted diene polymer. The diene polymers are grafted with nitrogen containing compounds having at least six carbon atoms such as N-vinylpyrrolidone.

U.S. Pat. No. 4,427,834 describes the polymerization of a nitrogen containing arm to a star polymer. The nitrogen containing arm is polymerized from cyclic momomers such as N-vinylimidazole and N-vinylpyrrolidone.

U.S. Pat. No. 4,699,723 and GB 1601079 describe the grafting of nitrogen containing compounds to olefin copolymers and terpolymers to improve dispersancy in oil compositions.

While it is generally known to prepare viscosity index improvers containing nitrogen, no effort has been made to carefully control the amount of nitrogen contained in the polymer or to obtain the advantages associated therewith. Moreover, no processes have been proposed for such careful control. The need, then, for a viscosity index improver concentrate containing a carefully controlled amount of nitrogen and for lubricating oils containing such a viscosity index improver concentrate and for a method of preparing the same is, then, believed to be readily apparent.

SUMMARY OF THE INVENTION

It has now been discovered that the foregoing and other disadvantages of the prior art nitrogen containing viscosity index improver concentrates, oil compositions containing the same and the processes for preparing the same can be overcome with the present invention. It is, therefore, an object of this invention to provide a nitrogen containing viscosity index improver concentrate having a carefully controlled amount of nitrogen therein, a process for preparing such a viscosity index improver and oil compositions containing the same. It is another object of this invention to provide such a nitrogen containing viscosity Index improver having improved clarity when compared to certain other nitrogen-containing viscosity index improvers.

In accordance with the present invention, the foregoing and other objects and advantages are accomplished with a viscosity index improver concentrates containing a controlled amount of N-vinylimidazole or optionally a controlled amount of N-vinylimidazole and N-vinylpyrrolidone, oil compositions containing the same and a method for preparing the same. The amount of either or each component in the polymer, viscosity index improver, is achieve by controlling the amount of each component in the reactants and the reaction conditions.

DETAILED DESCRIPTION OF THE INVENTION

The present invention includes the discovery that lubricating oil compositions which contain hydrogenated diene star polymers grafted with N-vinylimidazole enhance engine performance when produced by a process that controls the total nitrogen content of the oil composition.

The oil compositions of the invention are prepared from a star polymer concentrate which is produced by the process of mixing a mineral oil with at least 6% by weight of a star polymer, the star polymer comprising a poly(polyvinyl aromatic) nucleus bearing 4 to 30 arms of a hydrogenated, conjugated diene, each arm having a number average molecular weight from 10,000 to 100,000, and reacting the mixture with N-vinylimidazole or a combination of N-vinylimidazole and N-vinylpyrrolidone in the presence of a free radical initiator, wherein the total nitrogen content of the reactants as expressed in terms of wt. N-vinylimidazole×100/wt. polymer in the reaction mixture is between about 3.0–5.5 when N-vinylimidazole is the sole polymer reactant. When N-vinylimidazole (NVI) is used with N-vinylpyrrolidone (NVP) at an NVP:NVI ratio of about 3:1, the weight ratio of wt. of NVI×100/wt. polymer reactant will be within the general range of from about 1 to about 5, with a preferred range of from about 1 to about 2, and wt. ratios of NVP:NVI within from about 1:1 to about 4:1 are operable.

The star polymers described herein comprise a nucleus joining polymeric arms of hydrogenated homopolymers or copolymers of conjugated dienes, or selectively hydrogenated copolymers of conjugated dienes and mono-alkenyl arenes. The nucleus of the star polymer is preferably a poly(polyvinyl aromatic) coupling agent, such as poly(divinylbenzene), and suitably bears 4 to 30, preferably 5 to 10, polymeric arms. The polymeric arms are preferably hydrogenated polybutadiene or hydrogenated polyisoprene arms.

The star polymers are produced by the following reaction steps:

(a) polymerizing one or more conjugated dienes in solution in the presence of an ionic initiator to form a living polymer;

(b) reacting the living polymer with a polyvinyl aromatic compound, preferably divinyl benzene, to form a star-shaped polymer; and (c) hydrogenating the star-shaped polymer to remove at least 80% of the original olefinic unsaturation.

The preparation of the star diene polymer with optional mono-alkenyl arene blocks is described in more detail in U.S. Pat. No. 4,358,565 which is incorporated by reference herein.

The star polymers are grafted with N-vinylimidazole in a mineral oil solution that contains a free radical initiator and optionally N-vinylpyrrolidone. The free radical initiator may be any of those compounds known for this purpose in graft polymerization, preferably di-tert. butyl peroxide. The graft reaction medium is preferably a high viscosity index lubricating oil such as HVI 100N.

The amount of N-vinylimidazole contained in the reaction mixture is suitably between about 3.0 and about 5.5% wt, based on the amount of star polymer, for producing polymer concentrates containing at least 6 wt % polymer. In the case of a comonomer, such as N-vinylpyrrolidone, an amount of N-vinylimidazole between about 1.0 and about 2.0% wt is preferred.

The process for preparing the grafted hydrogenated star polymers may be carried out at a temperature between about 70° to about 180° C., but is preferably carried out at a temperature between about 140° and about 170° C. A convenient practical compromise between a short reaction time (requiring a higher reaction temperature) and satisfactory shear loss characteristics can be attained by an initial reaction at 148° C., followed by gradual heating to 165° C. The amount of free radical polymerization initiator is suitably chosen to balance the production of the necessary grafting sites on the star polymer and thereby the number of grafted chains, and the chain-length of the grafted chains and amounts within the range of about 1.5 to about 7.0 moles of monomer per mole of peroxide being generally suitable. In some cases, it may be convenient to dose both the free radical initiator and the grafting monomer gradually through the course of the reaction. In order to minimize undesirable side reactions, the process is preferably carried out under an inert atmosphere, conveniently nitrogen, with pressures between 1 and 50 bars being selected according to the constraints of the apparatus in use.

The grafted star polymer concentrates of this invention are blended with lubricating oils to improve engine performance. The lubricating oil compositions typically require from about 0.2% to about 3% by weight of a star polymer to have satisfactory viscometric properties. The grafted star polymers of the present invention improve engine performance when blended with lubricating oils that require an amount of star polymer between 0.2 and about 3.0% by weight.

PREFERRED EMBODIMENT OF THE INVENTION

In a preferred embodiment of this invention, a grafted radical (star-shaped) polymer will be prepared and used. The polymer will be grafted with N-vinylimidazole (NVI) by contacting the polymer with from about 3.0 to about 5.5 wt % NVI based on polymer as determined from the equation, wt % NVI = wt. NVI × 100/wt. polymer in reaction mixture. In the preferred embodiment, the polymer may also contain nitrogen derived from reaction, grafting, with N-vinylpyrrolidone (NVP). When NVP is used, it will be used in the grafting feedstock at an NVP:NVI ratio of about 3:1 and from about 1 to about 2 wt % of NVI will be used. The radial polymer which is grafted will contain from about 5 to about 10 polyisoprene homopolymer arms having weight average molecular weights ranging from about 30,000 to about 80,000. The number of arms contained in the radial polymer will be determined using gel permeation chromatography molecular weight techniques. In the preferred embodiment, the grafting will be accomplished using free radical techniques with di-t-butyl peroxoide being a particularly preferred free radical initiator. The free radical initiator will preferably be used at a concentration within the range from about 1.9 to about 5.0 moles total monomer (NVI+NVP) per mole of peroxide. The grafting will be accomplished in a suitable solvent such as HVI 100N base oil stock. The grafting will, preferably, be accomplished at a temperature within the range from about 140° C. to about 170° C. In a preferred embodiment, the radial polymer will be hydrogenated, prior to starting the grafting, so as to remove saturate, at least about 95% of the original unsaturation contained in the polymer. The core of the radial polymer will, preferably, be poly(divinylbenzene). In a preferred embodiment, when the polymer is used as an oil additive, it will be used at a concentration within the range from about 0.7 to about 1.5 wt % based on total oil.

Having thus broadly described the present invention and a preferred embodiment thereof, it is believed that the invention will become even more apparent by reference to the following examples. It will be appreciated, however, that the examples are presented solely for purposes of illustration and should not be construed as limiting the invention.

The invention is further illustrated in the following Examples, of which polymer concentrates A, B, G and J, and corresponding oil samples 1 and 4 are provided for comparison.

EXAMPLE 1

Following the procedures described in U.S. Pat. No. 4,358,565, there was prepared a star-shaped diene polymer having 6 to 10 hydrogenated polyisoprene arms coupled with divinylbenzene, each arm having a number average molecular weight of 35,000. The star-shaped polymer was taken up in Sun HVI 100N (low pour) oil and free radically grafted with N-vinylimidazole (NVI), N-vinylimidazole/N-vinylpyrrolidone (NVI/NVP), or 4-vinylpyridine (4-VP) to prepare polymer concentrates A through N as described in Table 1. The free radical initiator was di-t-butyl peroxide and the grafting temperature was increased from 148° C. to 165° C. over a reaction time of 2.75 hours. Viscometric properties of oil compositions containing the polymer concentrates, including the non-modified concentrate J, are detailed in Table 1.

The polymer concentrate G, which contained 12.5wt % star polymer grafted with 4-vinylpyridine, was typically hazy while the other polymer concentrates having star polymer concentrations equal to 12.5 wt % (A-F, HI and K-M) were suprisingly haze-free. Further, as shown in Table 1, the haze-free polymer concentrates of the present invention having wt. NVI×100/wt. polymer reactant values between 3.0 and 5.5% when NVI was used alone resulted in lubricating oil compositions having improved viscometric properties.

EXAMPLE 2

Lubricating oil compositions 1 through 8 were prepared using some of the polymer concentrates from example 1 and commercial polymer concentrate K in combination with the best available commercial additives as described in Table 2. Viscometric properties for the oil compositions confirms that the polymer concentrates of the present invention, having a wt. NVI×100/wt. polymer reactant value between 3.0 and 5.5% when NVI was used alone or a value between 1 and 2 wt % when NVI was used with NVP resulted in lubricating oil compositions having improved shear stability in comparison to polymer concentrate G.

EXAMPLE 3

The lubricating oil compositions of Example 2 were subjected to the Sequence V-E engine test procedure which is one of several engine tests which must be passed for a engine oil to be approved as an API SG quality lubricant. Certain of the results of the V-E test are presented in Table 3 which indicates that only sample 3 passed all of the test procedures shown. More of the oils would have passed all of the tests however if a larger amount of additive package had been used. In this regard, the concentration of additive package was intentionally kept low so as to observe the dramatic rise experienced by the dispersant VII candidates. Lubricating oil sample 4 contained star polymer grafted with N-vinylimidazole in an amount effective to give a wt. NVI×100/wt. polymer reactant ratio of 4.0%. Although samples having greater and lesser amounts of grafted N-vinylimidazole failed some of the tests, as did the samples containing both grafted N-vinylpyrrolidone and grafted N-vinylimidazole, the oil compositions of the present invention are surprisingly superior to the comparative compositions.

The proceeding examples are provided to describe embodiments of the invention and are not intended to limit the invention to an actual reduction to practice.

TABLE 1

| | STAR POLYMER CONCENTRATES AND BLENDS | | | | | | | |
|---|---|---|---|---|---|---|---|---|
| | A | B | C | D | E | F | G | H |
| Grafted Monomers | NVI | NVI/NVP | NVI/NVP | NVI | NVI/NVP | NVI | 4-VP | NVI |
| NVI/NVP mole ratio | — | 1/1 | 1/3 | — | 1/3 | — | — | — |
| Wt. NVI/wt. polymer, % | 6.0 | 2.97 | 1.5 | 4.0 | 1.06 | 3.0 | — | 4.95 |
| Wt. all monomers/wt. polymer, % | 6.0 | 6.48 | 6.81 | 4.0 | 4.79 | 3.0 | 4.46 | 4.95 |
| Polymer in Concentrate % w[a] | 12.54 | 12.54 | 12.54 | 12.54 | 12.54 | 12.54 | 12.54 | 12.54 |
| % w Polymer in Blend[b] | 1.33 | 1.33 | 1.33 | 1.4 | 1.4 | 1.4 | 1.4 | 1.4 |
| Vk 100° C., cSt | 11.64 | 11.41 | 11.07 | 11.69 | 11.42 | 11.47 | 11.52 | 11.86 |
| Vk 40° C., cSt | 67.20 | — | — | — | 67.08 | 67.09 | 66.32 | 69.13 |
| Viscosity Index | 170 | — | — | — | 165 | 166 | 164 | 169 |
| % Viscosity Loss[c] | 6.7 | 5.9 | 4.2 | 5.05 | 4.2 | 4.45 | 6.5 | 5.1 |

| | STAR POLYMER CONCENTRATES AND BLENDS | | | | | |
|---|---|---|---|---|---|---|
| | I | J | K | L | M | N |
| Grafted Monomers | NVI | — | NVI/NVP | NVI/NVP | NVI/NVP | NVI |
| NVI/NVP mole ratio | — | — | 1/3 | 1/3 | 1/3 | — |
| Wt. NVI/wt. polymer, % | 3.52 | — | 1.60 | 1.98 | 1.41 | 3.76 |
| Wt. all monomers/wt. polymer, % | 3.52 | — | 7.26 | 9.0 | 6.38 | 3.76 |
| Polymer in Concentrate % w[a] | 12.54 | 16.15 | 12.54 | 12.54 | 12.54 | 12.54 |
| % w Polymer in Blend[b] | 1.4 | 1.4 | 1.4 | 1.4 | 1.4 | 1.4 |
| Vk 100° C., cSt | 11.45 | 11.17 | 11.3 | 11.20 | 11.40 | 11.20 |
| Vk 40° C., cSt | 66.58 | 64.96 | — | — | — | — |
| Viscosity Index | 167 | 166 | — | — | — | — |
| % Viscosity Loss[c] | 4.5 | 1.4 | 4.0 | 4.6 | 4.6 | 4.6 |

[a]Polymer concentrates contain 87.46% Sun HVI 100N (low pour) mineral oil except J which contains 83.85% Shell HVI 100N mineral oil.
[b]Concentrates blended into HVI 100N (Atlas).
[c]Shear Stability Test (ASTM D3945).

TABLE 2

| LUBRICATING OIL SAMPLE[a] | POLYMER CONCENTRATES | PERCENT WEIGHT POLYMER | −30° C. TPI-MRV cP | −25° C. CCS cP | VK 100° C. cSt | VISCOSITY INDEX | PERCENT VISCOSITY LOSS[c] | 150° C.[d] TBS, cP |
|---|---|---|---|---|---|---|---|---|
| 1 (comparative) | J | 1.15 | 21,600 | 3340 | 11.21 | — | 1.1 | 3.14 |
| 2 | F | 1.04 | 21,300 | 3400 | 10.56 | 156 | 5.6 | 3.00 |
| 3 | D | 1.04 | 27,300 | 3460 | 10.74 | 159 | 5.8 | 3.01 |
| 4 (comparative) | A | 1.04 | 21,400 | 3420 | 11.31 | 159 | 9.0 | 2.99 |
| 5 | E | 1.04 | 24,400 | 3490 | 10.58 | 157 | 3.4 | 3.00 |
| 6 | C | 1.04 | 26,400 | 3420 | 10.80 | 159 | 5.1 | 3.02 |
| 7 | K[b] | 1.35 | 48,700 | 4030 | 11.42 | 156 | 13.2 | — |
| 8 | H | 1.04 | 22,000 | 3470 | 11.04 | 160 | 6.2 | 2.96 |
| 9 | I | 1.04 | 21,900 | 3390 | 10.82 | 160 | 4.3 | 2.98 |
| 10 | L | 1.04 | 19,000 | 3360 | 10.83 | — | 5.7 | 3.00 |
| 11 | M | 1.04 | 18,800 | 3430 | 10.85 | 163 | 4.5 | 2.89 |

TABLE 2-continued

| LUBRICATING OIL SAMPLE[a] | POLYMER CONCENTRATES | PERCENT WEIGHT POLYMER | −30° C. TPI-MRV cP | −25° C. CCS cP | VK 100° C. cSt | VISCOSITY INDEX | PERCENT VISCOSITY LOSS[c] | 150° C.[d] TBS, cP |
|---|---|---|---|---|---|---|---|---|
| 12 | N | 1.04 | 19,400 | 3490 | 10.75 | 160 | 5.3 | — |

[a]Oil samples contain 8.75% wt. of an experimental additive package, 0.3% Ethyl 623, Polymer concentrate, and HVI 100N (Atlas) oil, except sample 1 which has 9.1% of the experimental additive package plus the other ingredients.
[b]Formulated with TLA 7200A, which is a commercial dispersant made by Texaco.
[c]Shear Stability (ASTM D3945)
[d]High temperature, high shear rate viscosity as measured by tapered bearing simulator (ASTM D4683).

TABLE 3

| ENGINE TEST RESULTS[a] | LUBRICATING OIL SAMPLE 1 (COMP) | 2 | 3 | 4 | 5 | 6 | 7 (COMP) | PASS FAIL LIMITS | 8 | 9 | 10 | 11 |
|---|---|---|---|---|---|---|---|---|---|---|---|---|
| Average Sludge, Test End | 5.49 | 8.00 | 9.18 | 7.10 | 6.58 | 8.80 | 8.41 | 9.0 min. | 8.52 | 7.67 | 5.45 | 6.78 |
| Cam Cover Sludge | 6.03 | 8.33 | 8.48 | 7.87 | 7.09 | 8.58 | 8.96 | 7.0 min. | 8.52 | 7.67 | 5.45 | 6.78 |
| Average Piston Skirt Varnish | 6.70 | 6.70 | 6.94 | 7.02 | 6.82 | 6.68 | 6.94 | 6.5 min. | 6.85 | 6.78 | 6.84 | 6.95 |
| Average Varnish | 3.69 | 4.62 | 5.73 | 4.75 | 4.26 | 4.87 | 5.63 | 5.0 min. | 5.51 | 5.45 | 4.38 | 4.90 |

[a]Sequence VE Engine Test

TABLE 4

| Lubricating Oil Sample No. (same as in Table 3) | Star Polymer Concentrate and Blends (same as in Table 2) | $\frac{\text{Wt. of NVI}}{\text{Wt. of Polymer}} \times 100$ | Average Sludge |
|---|---|---|---|
| 1 | J | 0 (unfunctionalized) | 5.54 |
| 2 | F | 3.00 | 8.80 |
| 9 | I | 3.52 | 7.67 |
| 3 | D | 4.00 | 9.18 |
| 8 | H | 4.95 | 8.52 |
| 4 | A | 6.00 | 7.10 |

Table 4 correlates the data reported in Tables 1 and 3 by showing the average sludge values as a function of the amount of NVI in the polymer component of the oil composition. A high average sludge value indicates superior performance.

Sample #1, the unfunctionalized oil composition has the poorest average sludge value of 5.54. Samples nos. 2, 9, 3 and 8 containing from 3.0 to 4.95 wt. % NVI/wt. polymer have higher average sludge values than sample #1 (unfunctionalized) and sample #4 (6.0 wt % NVI/wt. polymer). These results clearly illustrate that amounts of 3–5 wt % NVI/wt. polymer represent the critical range of utility, and that differences in kind are obtained within these ranges.

What is claimed is:

1. A modified star polymer concentrate, produced by the process of:

mixing a mineral oil with at least 6% by weight of a star polymer, the star polymer comprising a poly(-polyvinyl aromatic) nucleus bearing 4 to 30 arms comprising a hydrogenated, conjugated diene, each arm having a number average molecular weight from 10,000 to 100,000; and reacting the mixture with N-vinylimidazole (NVI) or a combination of N-vinylimidazole and N-vinylpyrrolidone (NVP) in the presence of a free radical initiator, the wt. NVI×100/wt. polymer reactant value being between about 3.0 and about 5.5% when NVI is the sole reactant and a value between about 1.0 and about 5.0% when NVI is combined with NVP.

2. The polymer concentrate of claim 1, wherein the star polymer comprises a poly(divinylbenzene) nucleus bearing 5 to 10 arms of hydrogenated isoprene, each arm having a molecular weight from 30,000 to 80,000.

3. The polymer concentrate of claim 2, wherein the reaction mixture contains from about 1 to 2% by weight N-vinylimidazole.

4. A lubricating oil composition, produced by the process of:

mixing a mineral oil with at least 6% by weight of a star polymer, the star polymer comprising a poly(-polyvinyl aromatic) nucleus bearing 4 to 30 arms comprising a hydrogenated, conjugated diene, each arm having a number average molecular weight from 10,000 to 100,000;

reacting the mixture with N-vinylimidazole (NVI) or a combination of N-vinylimidazole and N-vinylpyrrolidone (NVI) in the presence of a free radical initiator, the wt. NVI×100/wt. polymer reactant value being between about 3.0 and about 5.5 when NVI is the sole reactant and a value between about 1.0 and about 5.0 when NVI is combined with NVP; and diluting the reaction product with a lubricating oil to give the oil composition a total star polymer content between 0.2 and 3.0% by weight.

5. The lubricating oil composition of claim 5, wherein the star polymer comprises a poly(divinylbenzene) nucleus bearing 4 to 10 arms of hydrogenated isoprene, each arm having a molecular weight from 30,000 to 80,000.

6. The lubricating oil composition of claim 5, wherein the star polymer is present within the range from about 0.7 to about 1.5% by weight based on polymer plus oil.

7. The lubricating oil composition of claim 5, wherein the reaction mixture contains from 1 to 2% by weight N-vinylimidazole.

8. A method of preparing a modified star polymer concentrate, comprising the steps of:

mixing a mineral oil with at least 6% by weight of a star polymer, the star polymer comprising a poly(-polyvinyl aromatic) nucleus bearing 4 to 30 arms comprising a hydrogenated, conjugated diene, each arm having a number average molecular weight from 10,000 to 100,000; and reacting the mixture with N-vinylimidazole (NVI) or a combination of N-vinylimidazole and N-vinylpyrrolidone (NVP) in the presence of a free radical initiator, the wt. NVI×100/wt. polymer reactant value being between about 3.0 and about 5.5% when NVI is the sole reactant and a value between about 1.0 and about 5.0% when NVI is combined with NVP.

9. The method of claim 8, wherein the star polymer comprises a poly(divinylbenzene) nucleus bearing 4 to 10 arms of hydrogenated isoprene, each arm having a molecular weight from 30,000 to 80,000.

10. The method of claim 9, wherein the raction mixture contains from about 1 to 2% by weight N-vinylimidazole.

11. A composition as in claim 1, wherein the value of NVI when combined with NVP is between about 1 to about 2.

12. A composition as in claim 4, wherein the value of NVI when combined with NVP is between about 1 to about 2.

13. A composition as in claim 8, wherein the value of NVI when combined with NVP is between about 1 to about 2.

* * * * *